United States Patent [19]

Woolaver et al.

[11] 4,398,486

[45] Aug. 16, 1983

[54] MECHANICAL ACTUATION DEVICE FOR SHIP ROLL STABILIZATION

[75] Inventors: Dennis A. Woolaver, Rockville, Md.; A. Erich Baitis, Stafford, Va.

[73] Assignee: The United States of America as represented by the Secretary of the Navy, Washington, D.C.

[21] Appl. No.: 247,485

[22] Filed: Mar. 25, 1981

[51] Int. Cl.[3] ..... B63B 39/06

[52] U.S. Cl. ..... 114/144 R; 114/144 RE; 114/146; 114/150; 114/121; 114/126

[58] Field of Search ..... 114/144 R, 144 RE, 144 B, 114/146, 150, 121, 122, 126, 330-332

[56] References Cited

U.S. PATENT DOCUMENTS

| | | | |
|---|---|---|---|
| 2,175,799 | 10/1939 | Hodgman | 114/144 R |
| 3,169,501 | 2/1965 | Wesner | 114/126 |
| 3,687,100 | 8/1972 | Larsh | 114/126 |

FOREIGN PATENT DOCUMENTS

| | | | |
|---|---|---|---|
| 173115 | 7/1922 | United Kingdom | 114/150 |

*Primary Examiner*—Trygve M. Blix
*Assistant Examiner*—C. T. Bartz
*Attorney, Agent, or Firm*—R. F. Beers; L. A. Marsh

[57] ABSTRACT

A ship steering system includes a pump assembly for controlling hydraulically actuated rudders, a first actuation unit for translating a helm steering command signal into a mechanical control signal for the pump assembly, and a second actuation unit for translating a combined helm steering command signal and ship roll reduction command signal into a mechanical control signal for the pump assembly. The second actuation unit includes an electrically activated mechanical actuator that translates the electrical helm and roll reduction command signal into a mechanical impulse that controls the operation of the pump assembly. The mechanical actuator includes a switch apparatus for switching the rudder control function from the first actuation unit to the second actuation unit when the switch apparatus and second actuation unit are activated. The mechanical actuator also includes an electrically activated fluid control valve that controls the flow of fluid to a rotary-vaned hydraulic actuator wherein the shaft thereof is linked to a coupling element of the switch apparatus. The coupling element is selectively engaged with a bearing member that operatively controls the pump assembly.

11 Claims, 5 Drawing Figures

95
90
91
93
92
56
81
83
80
82
151
94
84
100
111
110
106
141
152
153
140
141
145
180
161
156
161
120
107
121
157
157
154
155
181
74
75
71
72
73
70

MECHANICAL ACTUATION DEVICE FOR SHIP ROLL STABILIZATION

BACKGROUND OF THE INVENTION

This invention generally relates to motion stabilization systems and more particularly to roll reduction devices used aboard marine vessels.

As a result of the increased importance of helicopters and vertical takeoff-landing aircraft as an integral part of naval combat systems, a major thrust of recent research and development effort in surface ship dynamics has been directed toward improving ship/aircraft interfacing. Since the ship/aircraft interface is strongly dependent on weather, ship motions, and wave impact forces, it is desirable to reduce ship roll motions to minimize the possibility of damage to aircraft during landing and takeoff operations. Accordingly, a particular area of ship stabilization research has involved attempts to utilize the rudder systems of ships to control and reduce the rate and magnitude of ship roll motions. However, problems have been experienced in developing compatible roll reduction systems and devices because of operational interference between use of the rudder in reducing roll motions and utilization of the rudder as a steering mechanism.

SUMMARY OF THE INVENTION

The anti-roll device of the present invention overcomes drawbacks with the prior art by providing a roll reduction system which essentially comprises a hydraulic control means connected to the rudder; a pump means coupled to the hydraulic control means; flow control means connected to the pump means for controlling the flow rate of fluid through the pump means; and a first actuation means connected to the flow control means for translating helm signals into impulses for the flow control means. The roll stabilization device also includes a second actuation means for translating a combined helm and anti-roll signal into impulses for the flow control means. When the second actuation means is coupled to the flow control means and activated, the first actuation means is decoupled from the flow control means. This is accomplished with a mechanical clutch-/decoupler which is operatively connected to the first and second actuation means.

The second actuation means includes an electronic actuation control which combines the helm signals with signals from a roll rate sensor to provide a rudder command signal of a predetermined average magnitude. The resultant signal from the electronic controller is fed to a mechanical actuator for the second means that translates the electrical signal into a mechanical impulse for the flow control means.

The mechanical actuator includes an electrically activated switch means for activating the mechanical clutch/decoupler to switch the rudder control from the first means to the second switch means and vice-versa; and a hydraulically actuated transmission mechanism for translating the resultant electrical signal from the electronic controller into a mechanical impulse. The transmission mechanism includes an electrically activated fluid control valve that controls the flow of pressurized hydraulic fluid to a rotary-vaned hydraulic actuator. The shaft of the rotary actuator is linked to a coupling element of the mechanical clutch/decoupler to transmit the rudder command signal to the swash plate flow controls for the pump means. The shaft of the rotary actuator is also linked to a potentiometer so that the position of the rotary vane serves as position feedback of the location of the swash plate flow controls.

Accordingly, an object of the present invention is to stabilize marine vessels against wave and wind induced roll motions.

Another object of this invention is to provide a roll stabilization system for marine vessels which is coupled with the rudder of the ship without adversely affecting the steering of the vessel.

A further object of the present invention is to provide a mechanical actuation device for translating electrical rudder command signals into mechanical control impulses which cause the rudder of the ship to a move to a predetermined position.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may be best understood by reference to the following description taken in connection with the accompanying drawings, in which:

DETAILED DESCRIPTION OF THE INVENTION

Figure 1:
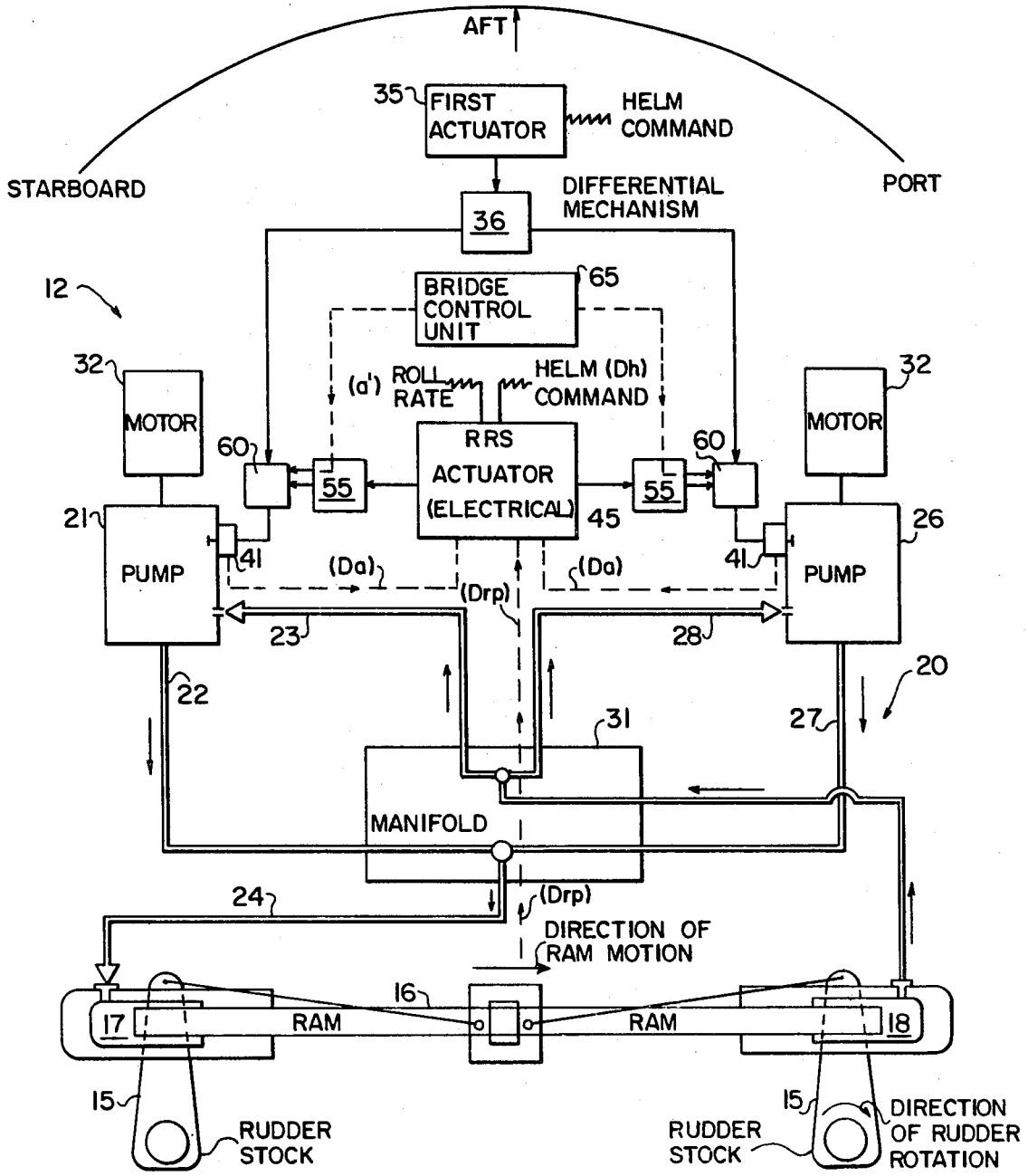
FIG. 1 is a simplified diagrammatic view of the roll reduction system of the present invention.

Referring now to the drawings and to FIG. 1 in particular, there is shown a simplified diagram of the roll reduction rudder control system 12 of the present invention. The roll reduction system 12 includes a hydraulically actuated control means in the form of a hydraulic fluid circuit 20 which is coupled to a hydraulic ram mechanism 16 that drives a tandem arrangement of rudders 15. A pump means comprising hydraulic pumps 21,26 and pump motors 32 is interconnected with the hydraulic circuit 20 to produce a preselected fluid flow in the hydraulic circuit 20 that causes ram mechanism 16 to move rudders 15 to a predetermined position. The roll reduction system 12 also includes a hydro-mechanical flow control means in the form of flow controls 41 that are coupled to pumps 21,26 for controlling the flow rate of hydraulic fluid through pumps 21,26; a first actuation means which is connected to flow controls 41 for translating helm signals into impulses for the flow controls 41; and a second actuation means for translating a combined helm and anti-roll signal into impulses for flow controls 41. The second actuation means is coupled to the flow controls 41 so that the first actuation means is decoupled from pumps 21,26 when the second actuation means is activated.

The ram mechanism 16 is pivotally connected to the arrangement of tandem rudders 15 so that a shift of the ram mechanism 16 in one direction causes a corresponding rotation of the rudders 15 in the same direction. More particularly, the end portions of the elongated ram mechanism 16 are contained within hydraulic chambers 17,18 so that a flow of pressurized fluid into chamber 17 causes a corresponding shift of the ram end portion out of the chamber 17. The hydraulic fluid circuit 20 includes two fluid conduits extending from each pump, wherein a flow line from one pump is connected to one of the hydraulic chambers 17 and the other flow line from such pump is connected to the other hydraulic chamber 18. Thus, in FIG. 1 ducts 22 and 23 from pump 21 are connected to respective chambers 17 and 18, and ducts 27 and 28 from pump 26 are connected to respective chambers 17 and 18. To provide a uniform response to impulses from the dual pumps, flow lines 22,27 are merged together into a single conduit 24 at manifold section 31, and flow lines 23,28 are merged together to form a single conduit 29 at manifold section 31.

Pumps 21 and 26 operate in response to the signals from flow controls 41 to cause the hydraulic fluid to flow through the pumps in a predetermined direction to the appropriate ducts and conduits at a predetermined pressure and flow rate. As shown for example in FIG. 1, the signal from flow controls 41, which is (often) referred to as the swash plate flow controls, has actuated pumps 21,26 to produce a flow of fluid out of right chamber 18 and into left chamber 17 as indicated by the arrows to cause a clockwise rotation of rudders 15. If the signals to the swash plate flow controls 41 change so that it is desired to rotate rudders 15 in a counterclockwise direction, a mechanical impulse is fed to pumps 21,26 to produce a flow of fluid into right chamber 18 and out of the left chamber 17. As rudders 15 approach the predetermined position, the flow of fluid through pumps 21,26 is continuously reduced until the flow rate reaches zero at the desired rudder position. A compatible pump 21,26 provided with an integral swash plate flow control 41 is manufactured by New York Air Brake (eg. part #890172, model 45L0172 or Dyna Power Models 30,45,60,120,210). A suitable electric pump motor 32 is manufactured by Reliance Electric Co. (Mil Spec. Mil-M-17060, Navy Service A Frame #286 UN).

The first actuation means includes an electromechanical actuation device 35, such as manufactured by Sperry Marine Division of Sperry Rand (Rotary Hydraulic Power Unit #1880060 or 1883174), that translates electrical helm signals into appropriate signals for a differential mechanism 36. The differential mechanisms 36, such as manufactured by Jered Inductries (Control Unit #20004-D), are connected to left and right swash plate flow controls 41 and translate the impulses from the first actuator 35 into a mechanical movement of the swash plate flow control 41 to a predetermined position. The relative position of the swash plate flow controls 41, with respect to a neutral position, causes pumps 21,26 to operate and produce a specific flow rate in the hydraulic lines.

The second actuation means includes an electrical roll reduction system actuator 45, herein referred to as a second actuator, that translates electrical signals from a roll rate sensor 46 and the helm into appropriate signals for a mechanical actuator 55 that is linked thereto. The particular electrical circuit details of the second actuator 45 set forth in a copending application entitled "ELECTRICAL ACTUATOR FOR SHIP ROLL STABILIZATION", Ser. No. 06/248,389, filed Mar. 31, 1981 by Dennis A. Woolaver and Ary E. Baitis, the teachings thereof are herein incorporated by reference. The mechanical actuators 55 for the second actuation means are coupled to mechanical clutch/decouplers 60, and the mechanical actuators 55 translate signals from second actuator 45 into mechanical impulses for the swash plate flow controls 41. Mechanical clutch-/decoupler device 60 interconnect the first and second actuators 35,45, with the swash plate flow controls 41 so that the clutch device 60 disengages the first actuator 35 and differential mechanism 36 from the swash plate flow controls 41 when the second actuation means is activated. The operative details of the mechanical clutch/decoupler device 60 are set forth in a copending application entitled "MECHANICAL CLUTCH-/DECOUPLER FOR HYDRAULIC PUMPS" Ser. No. 06/247,486, filed Mar. 25, 1981 by Dennis A. Woolaver and Ary. E. Baitis, the disclosure of which is herein incorporated by reference. Further operative details of the roll reduction unit 12 are set forth in a copending application entitled "SHIP ROLL STABILIZATION SYSTEM" Ser. No. 06/247,484, filed Mar. 25, 1981 by Dennis A. Woolaver and Ary E. Baitis, the teachings of which are herein incorporated by reference.

Figure 2:
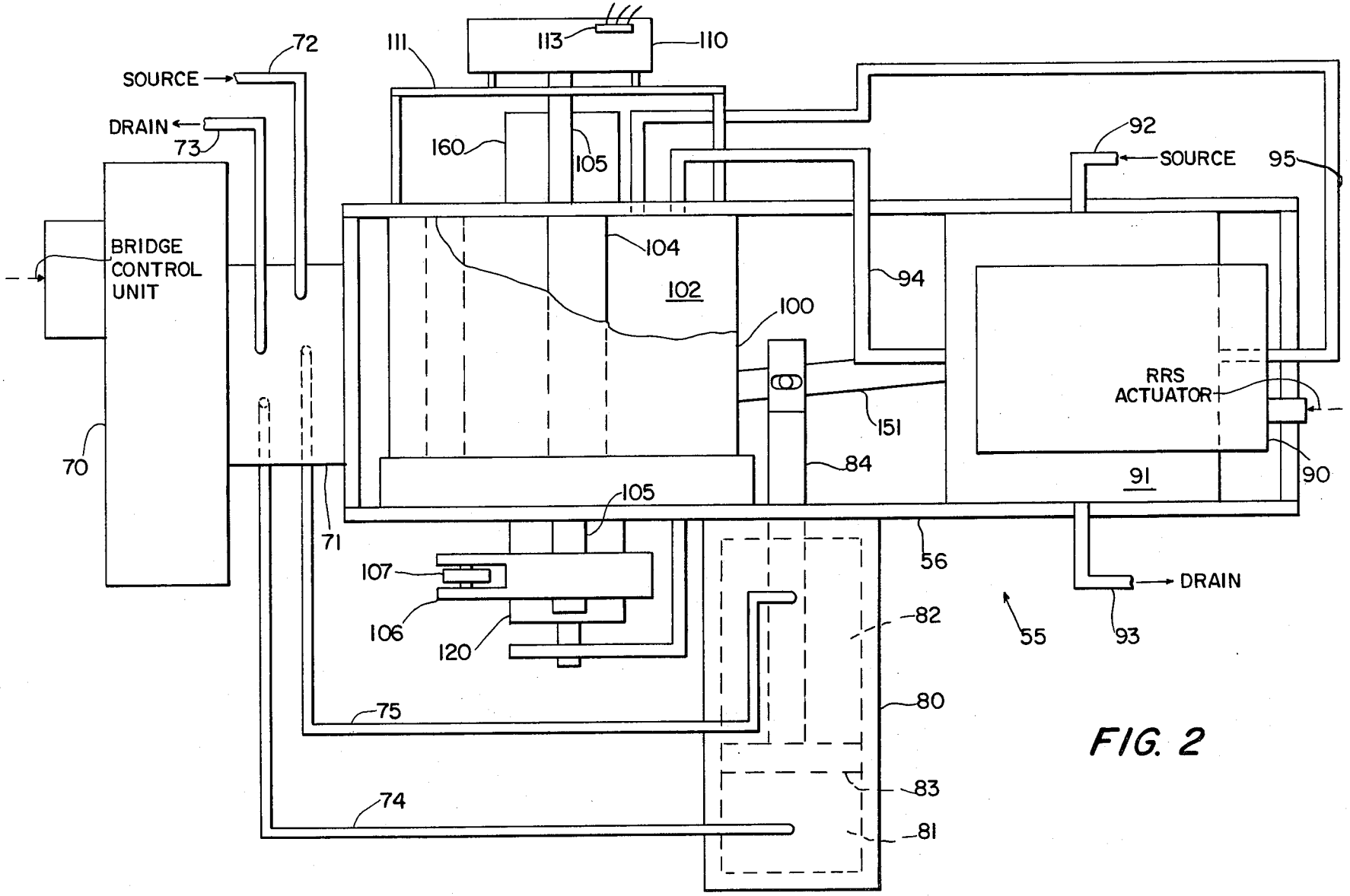
FIG. 2 is a top plan view of the mechanical actuator device of the invention.
Figure 3:
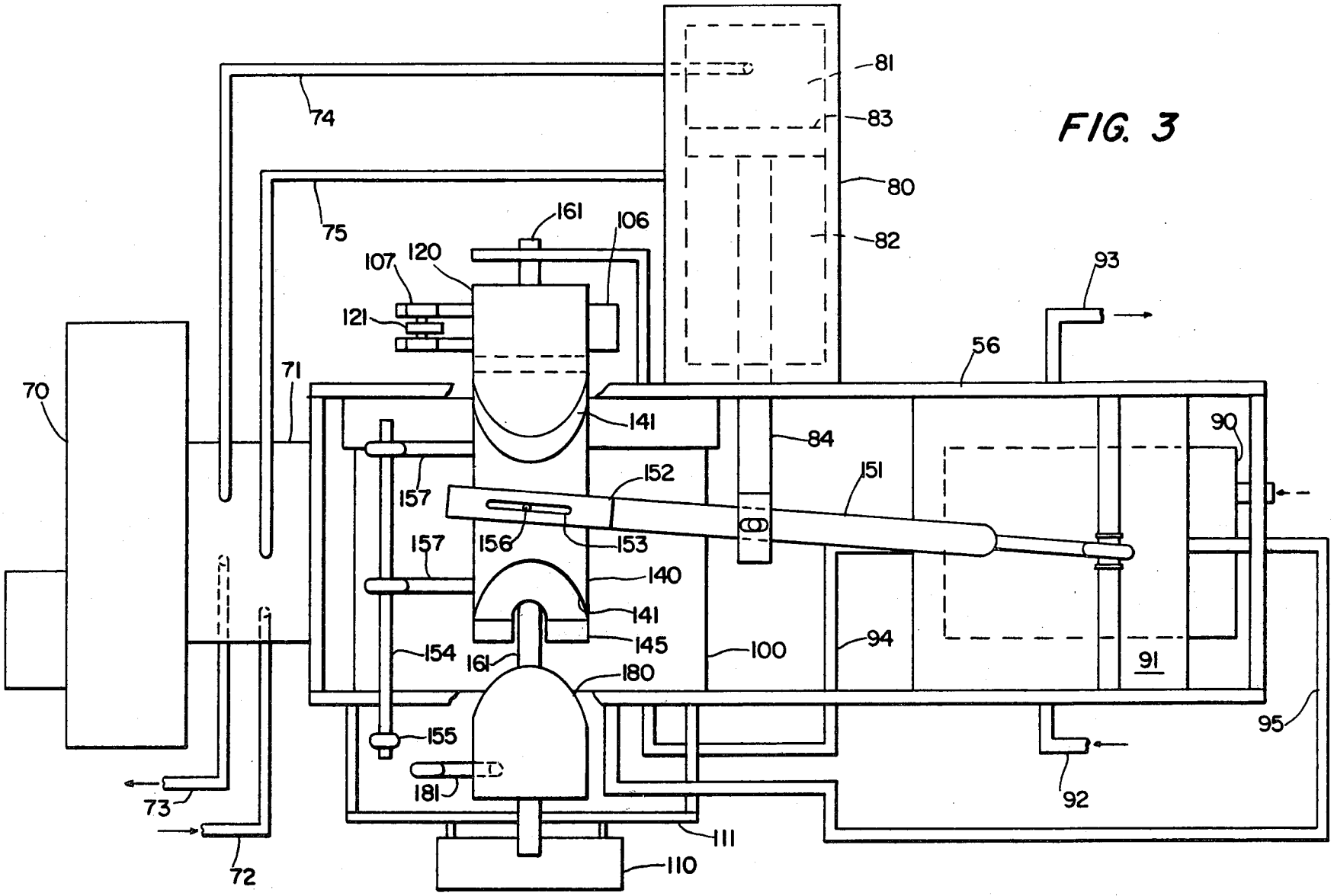
FIG. 3 is a bottom view of the mechanical actuator and mechanical clutch/decoupler of the invention.

Referring now to FIG. 2 there is shown a top plan view of the mechanical actuator 55 of the present invention. The mechanical actuator 55 includes a switch means in the form of a solenoid operated hydraulic valve 70 for activating a control piston 83 that drives a shift arm 151 of the mechanical decoupler 60. The solenoid operated valve 70, also referred to as a servo-valve, is of the general type disclosed in U.S. Pat. Nos. 3,023,782; 3,171,439; 3,736,958 and manufactured, for example, by the Parker Fluidpower Division of the Parker-Hannifin Corporation, Cleveland, Ohio (Model #3MD20AG). The servo-valve 70 functions as an "on-off" switch to control the flow of fluid in source line 72 and discharge line 73. In the "non-energized" mode, servo-valve 70 causes hydraulic fluid in source line 72 to flow into fluid line 74 and hydraulic fluid in fluid line 75 to flow into drain or discharge line 73. This causes control piston 83 and piston rod 84 to move toward the side plate 56 of mechanical actuator 60 so that shift arm 151, which is pivotally connected to piston rod 84, moves to engage a coupling element 160 of mechanical decoupler 60, as shown in FIG. 3. In this position, the first actuation means comprising first actuator 35 and differential mechanism 36 is operatively interlinked with the swash plate flow controls 41. In the "energized" mode of operation, servo-valve 70 reverses the flow of hydraulic fluid through manifold plate 71 so that the hydraulic fluid in source line 72 now flows through fluid line 75 to hydraulic chamber 82 and fluid in the other hydraulic chamber 81 flows through fluid line 74 and into discharge line 73. This causes control piston 83 to withdraw into the hydraulic cylinder 80, thereby moving shift arm 151 to decouple the first actuation means (actuator 35, differential mechanism 36) from the swash plate flow controls 41 and to operatively interconnect second actuator 45 with the swash plate flow controls 41. The servo-valve 70 is energized by switching bridge control unit 65 to the "on" position, which produces the electrical signal for the solenoid element of servo-valve 70, as indicated in FIG. 1 by the directional broken lines extending from bridge control unit 65 to mechanical actuator 55.

When servo-valve 70 is energized, second actuator 45 and mechanical actuator 55 become operatively coupled with the swash plate flow controls 41. The electrical signals from second actuator 45 are fed to a solenoid operated fluid control valve 90 to produce a predetermined flow rate in one of the outlet conduits connected to manifold unit 91. The solenoid operated fluid control valve 90, also referred to as a fluid control valve, is of the general type disclosed in U.S. Pat. Nos. 3,023,782; 3,228,423 and manufactured, for example, by the Controls Division of MOOG INC., East Aurora, New York (series model 62-102). A particular type of fluid control manufactured by Moog Inc. essentially includes a housing having a plurality of ports and containing an elongated valve spool provided with a plurality of spaced radial dividers. The elongated valve spool is positioned in the housing so that an axial displacement of the valve spool from a predetermined reference location causes fluid to flow through a selected port at a predetermined rate. An electrical torque motor is positioned in the housing and interconnected with the valve spool by a feedback element. An electrical signal in the form of an electrical current in the torque motor coils causes either a clockwise or counterclockwise torque on the armature, depending on the polarity (±) of the signal. This torque produces an axial displacement of the valve spool until the feedback torque acting through the feedback element counteracts the electromagnetic torque. At this time the valve spool remains in the predetermined displaced position until the electrical input signal from actuator 45 changes to a new value.

Thus, depending upon the polarity and magnitude of the electrical signal from second actuator 45, a specific flow pattern will be produced in manifold unit 91 and the conduits connected thereto. For example, when the magnitude of the resultant electrical signals from electrical actuator 45 is zero, the hydraulic fluid in source conduit 92 passes through the manifold unit to the discharge conduit 93. For a resultant signal of negative polarity, fluid control valve 90 interconnects source conduit 92 with fluid conduit 94 and fluid conduit 95 with the discharge conduit 93. Conversely, a resultant positive signal from second actuator 45 causes fluid control valve 90 to interconnect source conduit 92 with flow conduit 95 and flow conduit 94 with discharge conduit 93. The conduits are connected to a rotary-vane hydraulic actuator 100, which is shown partially broken away in FIG. 4. A rotary vane 104 divides the interior of rotary hydraulic actuator 100 into two subchambers 102,103 which are respectively connected to flow conduits 94,95. Thus, a flow of hydraulic fluid into subchamber 102 and out of subchamber 103 produces a counterclockwise rotation of rotary vane 104 in FIG. 4. The rotary hydraulic actuator is of the type disclosed in U.S. Pat. Nos. 3,198,090; 3,269,737; 3,620,131; 3,696,713 and manufactured, for example, by Ex-Cell-O Corporation, Greenville, Ohio (model No. S-250-1V).

Figure 4:
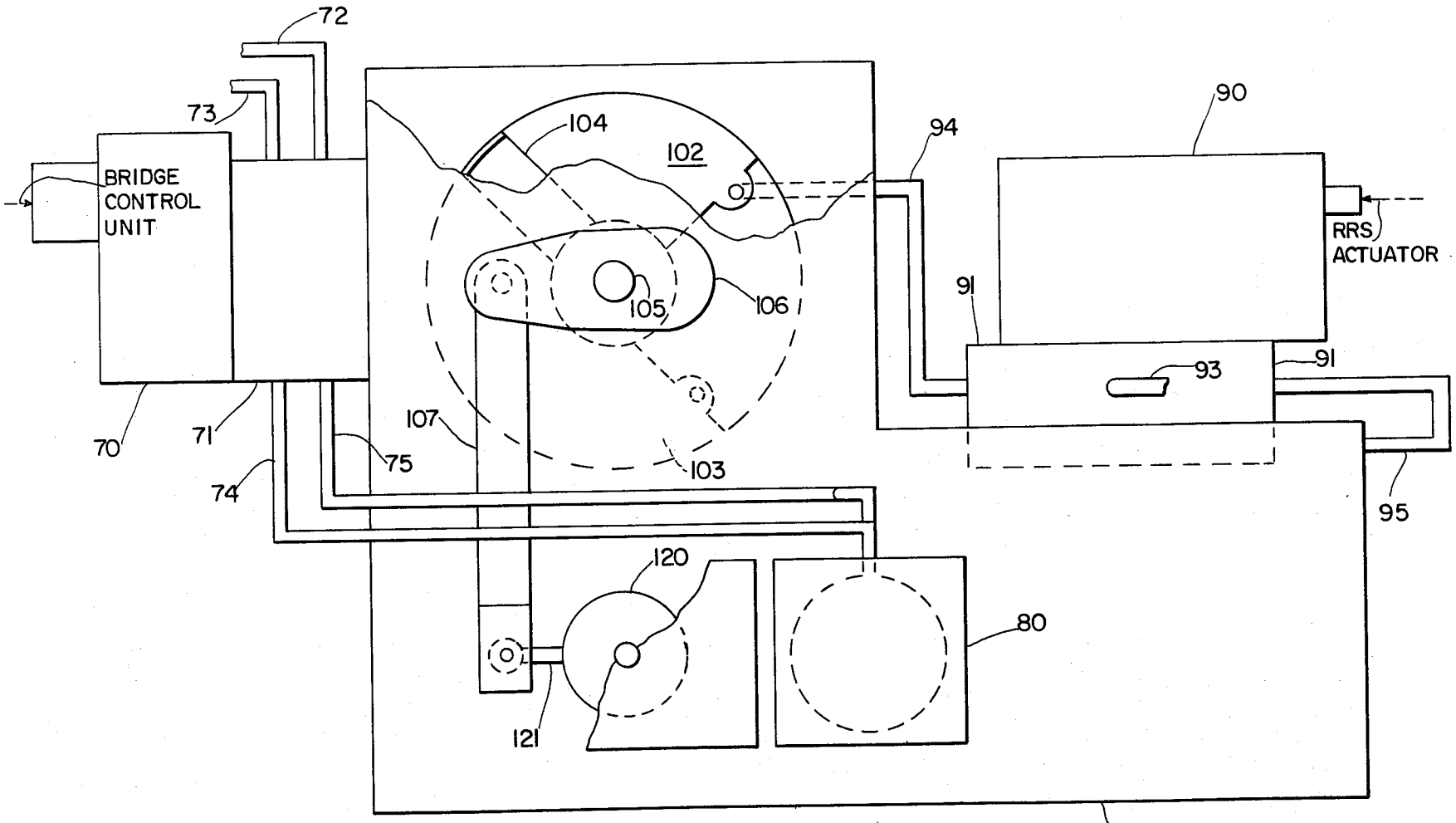
FIG. 4 is a side view of the mechanical actuator.

Rotationally keyed to one end portion of the rotating shaft 105 of rotary vane 104 is a pivot arm 106, as shown in FIG. 4. A linkage bar 107 pivotally interconnects pivot arm 106 with a lever element 121 secured to the second actuation means coupling element 120 of mechanical decoupler 60. An electrical signal from second actuator 45 activates flow control valve 90 to produce a rotation of rotary vane 104 to a predetermined position and thereby impart a likewise rotation of linkage bar 107. The movement of linkage bar 107 produces a rotation of the coupling element 120 for the second actuation means and, if the bearing element 140 of FIG. 3 is rotationally engaged therewith (ie. servo-valve 70 is energized), a corresponding movement of the flow controls 41 is effected. This produces a directional flow rate in the hydraulic pumps 21,26 which shifts the rudders 15 to a predetermined position.

Figure 5:
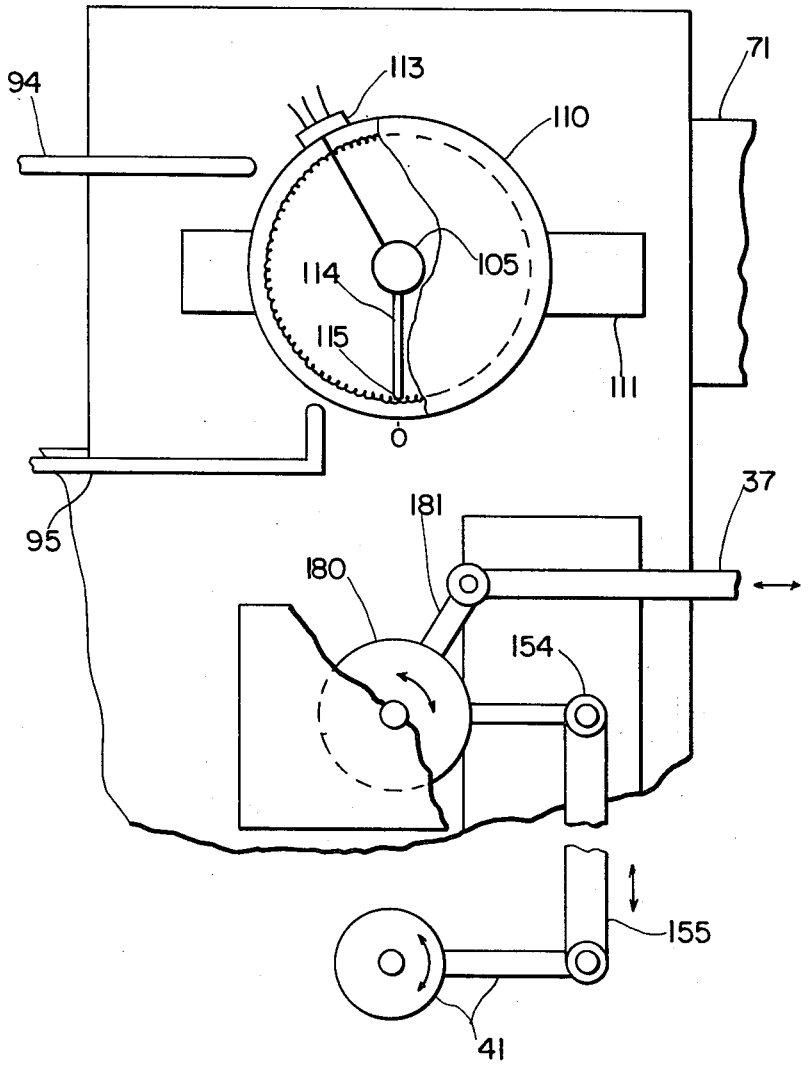
FIG. 5 is another side view, partially broken away, of the mechanical actuator.

Connected to the other end portion of rotating shaft 105 is a potentiometer 110 as shown partially broken away in FIG. 5. The potentiometer 110, which is held in a fixed position by bracket 111, includes a circumferential coil 112, an electrical contact means 113 for applying current to the coil 112, and a position indicator 114 which is attached to the end portion of rotating shaft 105. Upon rotation of shaft 105, the indicator likewise rotates and the indicator tip 115 makes contact with a different portion of coil 112. The position of indicator 114 with reference to a neutral position is representative of the position of the swash plate flow control 41.

In operation of the second actuation means, the feedback signal (Drp) from rudders 15 is fed to second actuator 45 to compare the actual position of the rudders with a desired rudder position as reflected by the rudder command signal (Drc) generated in second actuator 45. The resultant error signal (De), where (De=Drc−Drp), is compared with the feedback signal (Dpa) representing the position of the swash plate flow control 41. The feedback signal (Dpa) comes from contact means 113 on potentiometer 110. The resulting difference signal (Dsp), where (Dsp=De−Dpa), represents the signal that is fed to fluid control valve 90.

The roll reduction system is decoupled from the swash plate flow controls 41 by disengaging bearing member 140 from coupling element 120 upon de-energizing servo-valve 70. The bearing member 140 then moves to engage the coupling element 180 for the first actuation means, namely first actuator 35 and differential mechanism 36. In this mode, a direct linkage 37 from differential mechanism 36 drives the coupling element 180, as shown in FIG. 5, and the rotation of coupling element 180 and bearing member 140 as an integral unit produces a likewise rotation of the swash plate flow controls 41.

The bearing member 140 is provided with tapered end portions 141 that conform to V-shaped recesses in the mating portions of coupling elements 120,180. Thus, as bearing member 140 is driven by control piston 83 and shift arm 151 to engage coupling elements 120,180, bearing member 140 pivots to contiguously engage the respective coupling element. This produces a corresponding rotation of bar 154, which is supported from the bearing member, linkage 155, and swash plate flow control 41. A channel is formed in each coupling element to receive a conforming flange 145 formed on each end portion 141 of bearing member 140. This precludes separation of the coupling element and bearing member as torque is transmitted therebetween.

Obviously many modifications and variations of this invention are possible in light of the above teachings. It is therefore to be understood that within the scope of the appended claims the invention may be practiced otherwise than as specifically described.

What is claimed is:

1. A mechanical actuation device in a ship having rudders for translating electrical rudder command signals from an electrical actuation device into mechanical control signals for means hydraulically controlling the position of the rudders, comprises:

a hydraulic valve means having a plurality of flow paths and actuated by the electrical rudder command signal to produce a predetermined flow pattern in the flow paths;

a hydraulic actuator connected to the flow paths, the hydraulic actuator having a hydraulic chamber with a movable piston disposed therein for movement in response to fluid flow patterns in the flow paths, wherein the mechanical impulse produced by the hydraulic actuator is proportional to the electrical rudder command signal; and a mechanical coupling means including a coupling element connected to the movable piston of the hydraulic actuator, a bearing member connected to the means hydraulically controlling the position of the rudders, and switch means connected to the bearing member for shifting the bearing member to engage the coupling element upon activation of the switch means and for disengaging the bearing member from the coupling element upon deactivation of the switch means.

2. The mechanical actuator according to claim 1, wherein:

the flow paths of the hydraulic valve means include a supply conduit, a valve discharge conduit and two fluid conduits connected to opposite sides of the movable piston; and the movable piston of the hydraulic actuator comprises a rotary vane dividing the hydraulic chamber into two variable volume subchambers; and the rotary vane is arranged to rotate from an initial position in response to flow of fluid into one of the subchambers and out of the other subchamber.

3. The mechanical actuator according to claim 2, wherein:

the coupling element and bearing member are coaxially positioned to oscillate about a support shaft, and further comprising:

a linkage means connected to one end portion of the shaft for the rotary vane and further connected to the coupling element for producing a rotational displacement of the coupling element upon rotation of the rotary vane from a previous position.

4. The mechanical actuator according to claim 3, wherein:

the switch means includes an electrically operated fluid valve having a plurality of fluid lines, a hydraulic cylinder having a control piston with an integral piston rod positioned within the hydraulic cylinder with fluid lines connected to opposite sides of the control piston, and a shift arm connected to the piston rod and the bearing member for shifting the bearing member to engage the coupling element upon activation of the switch means and to disengage with the coupling element upon deactivation of the switch means.

5. The mechanical actuator according to claim 4, wherein:

the coupling element is provided with a V-shaped recess and the adjacent end portion of the bearing member is provided with a V-shaped projection that is configured to contiguously conform to the V-shaped recess of the coupling element.

6. The mechanical actuator according to claim 5, wherein:

the apex angle of the V-shaped recess is between about 40° and about 90°.

7. The mechanical actuator according to claim 5, wherein:

the distal end of the V-shaped projection is provided with a rectangular flange portion and the apex of the V-shaped recess is provided with a conforming channel-shaped recess region.

8. The mechanical actuator according to claim 1, wherein:

the coupling element is provided with a V-shaped recess and the adjacent end portion of the bearing member is provided with a V-shaped projection that is configured to contiguously conform to the V-shaped recess of the coupling element.

9. The mechanical actuator according to claim 8, wherein:

the distal end of the V-shaped projection is provided with a rectangular flange portion and the apex of the V-shaped recess is provided with a conforming channel-shaped recess region.

10. The mechanical actuator according to claim 1, wherein:

one of the coupling element and bearing member is provided with a V-shaped recess and the other of the coupling element and bearing member is provided with a V-shaped projection that is configured to conformingly engage the V-shaped recess.

11. The mechanical actuator according to claim 3, wherein:

a potentiometer is connected to the other end portion of the shaft for the rotary vane, the potentiometer including a potentiometer indicator secured to the oscillating shaft for movement therewith for making a sliding electrical contact with a potentiometer coil, and the electrical signal from the potentiometer is fed to the electrical actuator to indicate the position of the bearing member controlling the hydraulic means for controlling the position of the rudder.

* * * * *